United States Patent [19]

Nelson

[11] Patent Number: 4,581,686

[45] Date of Patent: Apr. 8, 1986

[54] ROTATING HEAD SWITCH MECHANISM FOR FLASHLIGHT

[75] Inventor: Norman C. Nelson, Newberry Springs, Calif.

[73] Assignee: Streamlight, Inc., Norriston, Pa.

[21] Appl. No.: 650,116

[22] Filed: Sep. 13, 1984

[51] Int. Cl.[4] ..... F21L 9/00

[52] U.S. Cl. ..... 362/204; 362/205; 362/186

[58] Field of Search ..... 362/186, 202–206

[56] References Cited

U.S. PATENT DOCUMENTS

| | | | |
|---|---|---|---|
| 2,852,633 | 9/1958 | Garland | 362/205 X |
| 2,912,567 | 11/1959 | Dulberg | 362/203 |
| 4,156,893 | 5/1979 | Baake | 362/186 X |
| 4,234,913 | 11/1980 | Ramme | 362/203 X |
| 4,398,238 | 8/1983 | Nelson | 362/202 X |

*Primary Examiner*—Peter A. Nelson

*Attorney, Agent, or Firm*—Gene W. Arant

[57] ABSTRACT

The present invention relates to a flashlight assembly having a rotatable head which acts as a switch mechanism for turning the light on or off.

The flashlight has an elongated metal housing, and the rotatable head is also made of metal. A spacer member made of an electrical insulating material is securely attached to the head member. The spacer member threadedly engages threads formed on the housing. Thus, there is normally no electrical continuity between the metal head member and the metal housing. However, when the head member is rotated in a tightening direction, a flat annular face on the head member comes into mating engagement with a similar face on the housing, thus establishing electrical continuity between those two members and completing the internal electrical circuit of the flashlight.

8 Claims, 6 Drawing Figures

ROTATING HEAD SWITCH MECHANISM FOR FLASHLIGHT

BACKGROUND OF THE INVENTION

Various types of switch mechanisms for flashlights are known in the prior art. It has been previously known to accomplish a switching action by rotating the head of the flashlight relative to the body or housing of the flashlight.

The present invention provides such a mechanism which is believed to be particularly advantageous in the manner in which it is constructed.

It is a particular object of the invention to provide a flashlight of sturdy, weather-proof metal construction, in which the switching action is accomplished by rotation of the head relative to the body or housing of the flashlight.

SUMMARY OF THE INVENTION

According to one feature of the invention a spacer member made of electrical insulating material is interposed between the head and body of the flashlight, and securely fashioned to one of those members while being threadedly engaged with the other. The head and body are thus normally insulated from each other, but a tightening of the head brings a flat annular face on the head into conductive engagement with a similar face on the end of the housing, thus completing the internal circuit of the flashlight.

According to another feature of the invention the spacer member made of electrical insulating material fits about a reduced diameter portion of the head member, and is permanently secured thereon. The spacer member has external threads which engage internal threads of the metal housing of the flashlight. The spacer member is made of an ABS plastic material, and its cylindrical inner surface is secured to the reduced diameter portion of the head member by means of plastic gluing, with the result that the dimensional stability of the threads on the spacer member is not impaired.

DRAWING SUMMARY

DETAILED DESCRIPTION

Figures 1, 2, 3, 4, 5, 6:
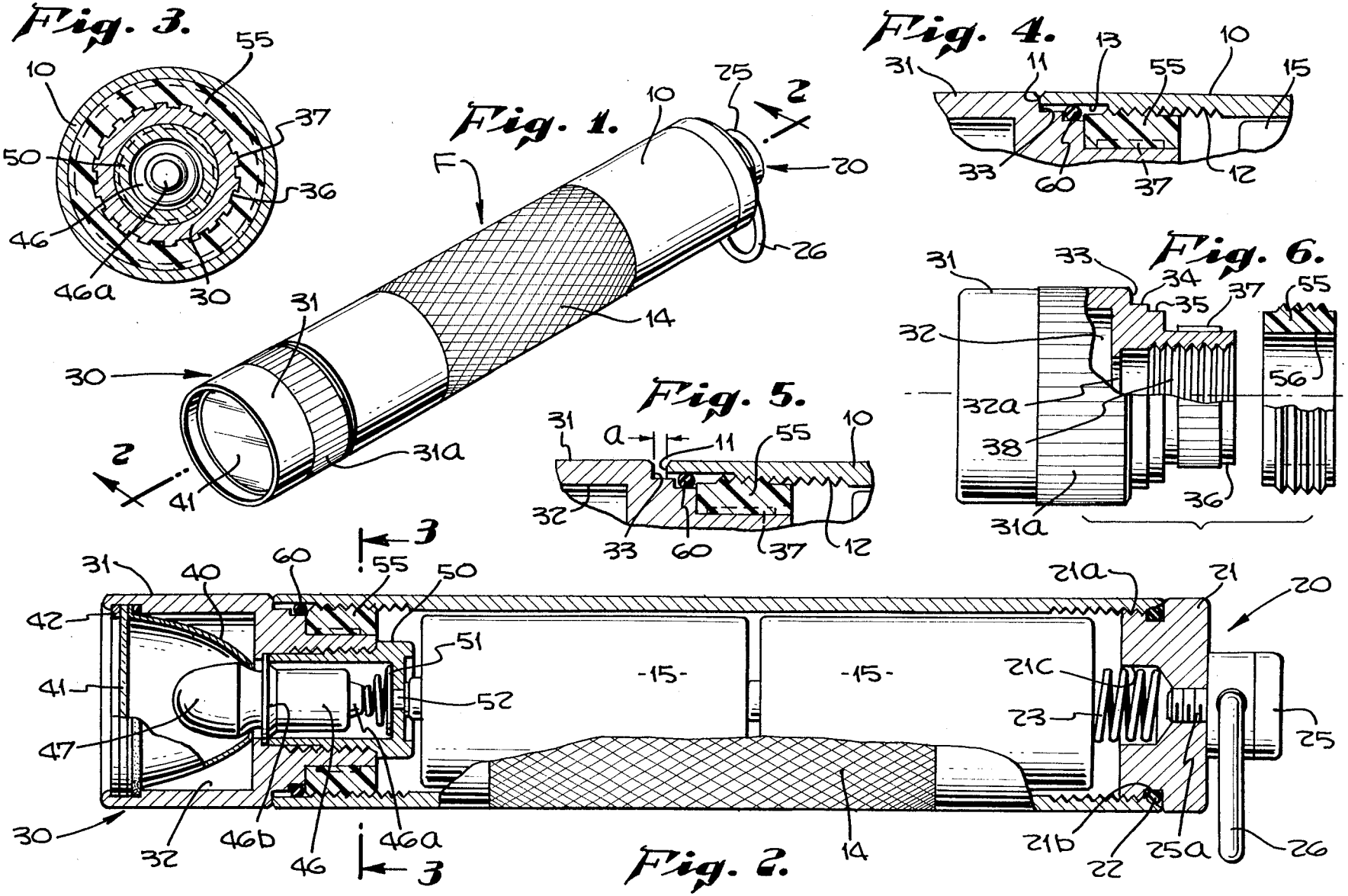
FIG. 1 is a perspective view of a flashlight in accordance with the presently preferred form of the invention.
FIG. 2 is a longitudinal cross-sectional view of the flashlight taken on line 2—2 of FIG. 1.
FIG. 3 is a transverse cross-sectional view taken on the line 3—3 of FIG. 2.
FIG. 4 is a fragmentary cross-sectional view showing the head member tightened against the flashlight body so as to complete the electrical circuit and light the flashlight.
FIG. 5 is a fragmentary cross-sectional view like FIG. 4, but showing the head member loosened so as to interrupt the flashlight circuit.
FIG. 6 is an exploded assembly view, partially in cross-section, of the head member and the insulating spacer associated with it.

Since all of the drawing figures show a single embodiment of the flashlight, the description will not need to refer to any particular figures, but will only designate the parts by their appropriate name and reference numeral.

The complete flashlight F includes an elongated hollow cylindrical metal housing 10. Inside the housing 10 are two batteries 15 of conventional configuration. The rearward end of housing 10 is closed by means of a tail cap assembly 20.

Tail cap assembly 20 includes a solid metal tail cap 21, having external threads 21*a* on its inner end which engage threads 14 formed on the interior wall of the housing 10. A circumferential groove 21*b* is formed in the tail cap 21, and receives a grommet or seal ring 22 which provides a water-proof joint between the tail cap and the housing. In the inner end of the tail cap 21 a central opening 21*c* receives a tail cap spring 23. Spring 23 is held in compression in conventional fashion, thus holding the batteries 15 in place while at the same time providing electrical continuity between the center of the rearmost one of the batteries and metal tail cap 21.

Although no part of the present invention, a D-ring holder 25 has the form of a cylindrical metal plug, and on its forward end has a threaded shank 25*a* which is secured into a threaded opening in the center of tail cap member 21. The D-ring holder 25 has a transverse opening which supports a D-ring 26.

The head assembly of the flashlight F is generally designated by numeral 30. It includes a metal head member 31 having a particular configuration as best seen in FIGS. 2, 3, and 6. The forward end of the head member 31 contains a generally cylindrical reflector chamber 32. The head member 31 is itself of a generally hollow cylindrical configuration. However, a short distance rearwardly of the reflector chamber 32 the outer diameter of the head member 31 is reduced as shown at 34. Adjacent the reduced diameter surface 34 is a flat annular face 33 which faces rearwardly toward the forward end of the metal housing 10. Another short distance rearwardly the outer diameter of the head member is again reduced at 35. Still a further distance rearwardly the outer diameter of the head member is reduced at 36 to a much smaller diameter. The surface 36 is of a generally cylindrical configuration but with longitudinal splines 37 formed thereon. The splines are spaced around the full circumference of the head member, as best seen in FIG. 3. Inside the reduced diameter portion 36 of head member 31, the inner wall of the head member is threaded at 38, as best seen in FIGS. 2 and 6. Forwardly of threads 38 is an annular lip or shoulder 32*a*.

Also part of the head assembly 30 is a reflector 40, which is of a generally parabolic configuration and fits within the reflector chamber 32. A flat circular lens 41 is positioned across the forward and otherwise open end of the reflector. Lens 41 is held in place by a retaining ring 42, which is located within the forward lip of the head member 31, all in a conventional manner.

A conventional bulb assembly 45 is shown only in FIG. 2. It includes a metal can 46 having a rear end terminal 46*a*, and a circumferential outwardly extending metal flange 46*b* spaced from the forward end of the can. A glass bulb 47 projects forwardly from the metal can. Though not specifically shown, the flange 46*b* is insulated from the can 46, and the internal connections to the bulb 47 are such that one electrical terminal is provided by the forward flange 46*b* while the other electrical terminal is provided by the rear end terminal 46*a*.

A conventional bulb retainer 50 has a generally cup-shaped configuration and is made of an electrical insulating material. It has an exterior thread which is matingly engaged with the interior thread 38 of the reduced diameter rearward end of head member 31. The forward end of bulb retainer 50 butts against the metal flange 46*b* of the bulb assembly, forcing this flange into conductive engagement with circular flange 32*a* at the rearward end of reflector chamber 32. A small compression spring 51 occupies the space between rear end terminal 46*a* of the bulb assembly 45 and the rear wall of the bulb retainer 50. A small metal contact member 52 carried in a central opening in the rear wall of bulb retainer 50 is conductively attached to the spring 51. Thus, with the bulb assembly and bulb retainer in their normal positions as shown in FIG. 2, the internal circuit of the flashlight is provided as follows. The forward contact on the forward one of the batteries 15 engages contact member 52 which is conductively connected through spring 41 to the rear end terminal 46*a* of the bulb assembly. That terminal 46*a* is connected internally to one side of the lamp filament. The other side of the lamp filament is internally connected to the flat circular flange 46*b* of the bulb assembly. Flange 46*b* is in conductive engagement with the internal lip or flange 32*a* of head member 31, and thus in conductive contact with the head member itself.

At the same time, electrical conductivity is established between the two batteries 15, and from the rearward one of the batteries through the tail cap spring 23 to the metal tail cap member 21, and hence through threads 21*a* of the tail cap member and the mating threads 14 of the housing to the main body or housing 10 of the flashlight. Therefore, in order to turn on the lamp inside the bulb housing 47, it is only necessary to provide a conductive connection between the metal housing or body 10 and the metal flashlight head 31.

A spacer member 55, FIGS. 4, 5 and 6, is of a generally cylindrical or ring-shaped configuration. As shown in the partial cross-section view of FIG. 6, it has an internal surface 56 which is of a smooth cylindrical configuration. It also has threads 57 formed on its exterior surface. Spacer member 55 is preferably made from a rigid ABS plastic material.

Spacer member 55 is assembled to the reduced diameter rearward end of the head member 31 in the following manner. The interior cylindrical surface 56 of the spacer member 55 is wiped with a liquid which causes the plastic material to momentarily soften or melt. Then the spacer member is slid longitudinally over the cylindrical surface 36 of the head member 31, thus encountering the longitudinal splines 37. It is forced over the splines until it completely encompasses them. A period of time is then allowed for the plastic material to harden or set. This accomplishes a plastic gluing operation. The result is a rigid assembly as best seen in FIG. 2 wherein the spacer member 55 in effect becomes a part of the head member 31.

The importance of the selection of the ABS material and the method of attaching it to the splined surface 36, 37, is as follows. It is essential to maintain the dimensional integrity of threads 57 on the external surface of the spacer member 55. The technique of melting the internal surface only of the plastic material permits the spacer member 55 to be permanently secured to the head member 31, but without impairing the dimensional integrity of the threads 57.

The one remaining part of the flashlight F is a resilient seal-ring 60. It rests upon the reduced diameter surface 35 of the head member 31. Although the seal ring 60 may perhaps be stretched to position it after spacer member 55 has been attached to the head member 31, it may nevertheless be preferred to put it in its proper position first, before attaching the spacer member.

The switching action is illustrated in FIGS. 4 and 5. In FIG. 5, a rearwardly facing flat annular face on the head member 31 is designated as 33. A forwardly facing flat annular face on the forward extremity of housing 10 is designated as 11. Since the head member has been rotated to a relatively loose position, a small distance "a" separates the flat annular faces 33 and 11 from each other, and the light remains off.

In FIG. 4, however, the head member has been rotated to a tightened position. This is accomplished by rotating the head member 31 and thus rotating the exterior threads 57 of spacer member 55 in threaded engagement with the interior threads 12 of the forward end portion of the housing member 10. This tightening action results in conductive engagement of the flat annular faces 33, 11, and thus completes the internal electrical circuit of the flashlight F, turning it on.

In actual practice, it is necessary to rotate the head member 31 by only about five degrees in order to switch the light on or off.

A detail of some significance to the weather-proof sealing action of the flashlight is shown in FIGS. 4 and 5. Inside the extreme forward end of the housing or body 10 the wall is thinned to provide a smooth cylindrical surface 13. The threads 12 extend rearwardly of the surface 13 but having a smaller diameter. Seal ring 60 is of such thickness as to provide a sealing fit between cylindrical surface 35 of the head member and cylindrical surface 13 of the housing. During the rotating movement of the head member, as the head is tightened or loosened and the flashlight F is switched on or off, seal ring 60 slides longitudinally of the interior surface 13 of housing 10. However, its position on the head member 31 is fixed, because the exterior diameter of the spacer 55 is somewhat larger than the diameter of cylindrical surface 35, with the result that cylindrical surface 35 in effect provides a groove within which the seal ring 60 is captured.

Besides having a sturdy and weather-proof configuration, the flashlight assembly F of the present invention is also adapted to optimize the convenience and economy of the manufacturing process. The main part of the outer surface of housing or body 10 is preferably knurled, as shown at 14 in FIG. 1, for convenient handgripping. A portion of the exterior surface of head member 31 is also knurled as at 31*a* for convenience of gripping action.

The metal members 10, 21, and 31 are preferably made of aluminum material, and are preferably anodized to provide a weather-resistant finish. The anodizing, however, results in a rather high contact resistance for electrical purposes. Therefore, the head member 31 is milled or ground at two separate points in order to ensure good electrical continuity. One of these points is the interior or rearward surface of the lip or flange 32*a*, being a flat annular face. The other is the flat annular face 33 adjacent the outer circumference of the head member. Likewise, the flat annular face 11 on the forward extremity of the housing 10 is milled or ground in order to provide a good electrical contact surface.

It is here pointed out that although the present invention has been shown and described with reference to a particular embodiment, nevertheless, various changes and modifications obvious to one skilled in the art to which the invention pertains are deemed to lie within the purview of the invention.

What is claimed and desired to be secured by Letters Patent of the United States is:

1. A flashlight assembly with a rotatable head acting as a switch mechanism, said assembly comprising:

an elongated hollow metal housing containing at least one battery, and having a threaded forward end for receiving a flashlight head;

a metal flashlight head carrying a bulb holder and a reflector, said flashlight head being threadedly mounted upon said forward end of said housing in electrically insulated relation thereto;

said bulb holder having two terminals for carrying electrical current, one being in conductive engagement with said flashlight head and the other having associated spring contact means providing a current conducting path to said battery;

means providing a conductive path between said battery and said housing;

said housing having on the extremity of its forward end a flat annular face; and said flashlight head having a flat annular face adapted for mating engagement with said face of said housing, whereby the rotation of said head to a tight position produces electrically conductive engagement of said two faces and thereby completes the electrical circuit of the flashlight.

2. A flashlight assembly as in claim 1 wherein both said housing and said head are anodized, with said flat annular faces thereof being ground to remove the anodized material.

3. A flashlight assembly as in claim 1 wherein said housing is threaded on its interior wall, wherein the rearward end of said flashlight head is of reduced diameter, and which further includes a spacer member made of an insulating material and which is of a generally ring-shaped configuration, the inner wall of said spacer member being permanently secured upon said reduced diameter rearward end of said flashlight head while the outward wall of said spacer member is threaded and engages the threads on the interior wall of said housing.

4. In a flashlight, a head assembly adapted for selectively completing or interrupting the electrical circuit of the flashlight by means of a rotating action, comprising:

an elongated hollow metal housing having a flat annular face on the extremity of its forward end, and being threaded on one cylindrical surface near its forward end;

a metal flashlight head adapted to extend forwardly from said housing and having a rearward end adapted to be disposed concentric to said forward end of said housing, said flashlight head also having a rearwardly facing flat annular face adapted for mating engagement with said annular face of said housing; and a generally ring-shaped spacer member made of a rigid electrical insulating material and occupying a space between said housing and said head, one cylindrical surface of said spacer member being permanently secured to said flashlight head while the other surface thereof has threads which engage the threads of said housing;

whereby rotation of said head relative to said housing will either make or break electrical continuity between them.

5. A flashlight head assembly as in claim 4 wherein the rearward end of said flashlight head is disposed within said housing, said spacer member fits about said flashlight head, and the outer surface of said spacer member is threaded.

6. A flashlight head assembly as in claim 5 wherein said spacer member is made of ABS plastic, the rearward end of said flashlight head has a longitudinally splined surface, and the inner surface of said spacer member is permanently secured to said splined surface by means of plastic gluing.

7. A flashlight head assembly as in claim 5 which further includes a resilient seal ring disposed between concentric cylindrical surfaces of said housing and said head, intermediate to said mating flat face and the threaded surface of said housing.

8. In a flashlight assembly having a metal housing with a threaded end and a metal flashlight head threadedly supported therefrom, and wherein relative rotation between the head and the housing is employed for opening or closing the electric circuit of the flashlight, the improvement comprising:

electrical insulating means associated with one of said head and said housing and providing the threads thereof so as to prevent thread-to-thread electrical continuity between said head and said housing;

said head and said housing each having a metal end face or shoulder providing a flat annular metal contact surface;

whereby a relatively small angular rotation of said head relative to said housing will cause said contact surfaces to engage or disengage and thereby switch the flashlight on or off.

* * * * *